US006349486B1

(12) United States Patent
Lin

(10) Patent No.: US 6,349,486 B1
(45) Date of Patent: Feb. 26, 2002

(54) CONSUMER-MODIFIABLE SANDAL OR SLIPPER

(75) Inventor: Ghing-Yi Lin, Taichung Hsien (TW)

(73) Assignee: Gnan-Jang Plastics Co., Ltd. (TW)

( * ) Notice: Subject to any disclaimer, the term of this patent is extended or adjusted under 35 U.S.C. 154(b) by 0 days.

(21) Appl. No.: 09/569,870

(22) Filed: May 12, 2000

(51) Int. Cl.[7] ..... A43B 3/12; A43B 3/24
(52) U.S. Cl. ..... 36/101; 36/15
(58) Field of Search ..... 36/101, 100, 11.5

(56) References Cited

U.S. PATENT DOCUMENTS 2,368,314 A * 1/1945 Marx
3,983,642 A * 10/1976 Liao
4,193,214 A * 3/1980 Wang
4,839,948 A * 6/1989 Boros
4,887,369 A * 12/1989 Bailey
5,802,738 A * 9/1998 Ferniani
5,896,684 A * 4/1999 Lin

* cited by examiner

*Primary Examiner*—Ted Kavanaugh
(74) *Attorney, Agent, or Firm*—Bacon & Thomas, PLLC

(57) ABSTRACT

A type of consumer-modifiable sandal or slipper, chiefly including: A sole into which are inserted two straps. Several assembly bases are embedded in the sole, and serve to hold the strap clips on the straps. The outer edges of the assembly bases are exposed on the surface of the sole. The assembly bases contain insertion holes with upward-facing openings. Window holes pierce the rim of the outer edge of the insertion holes. An insertion plate extends from the bottom of each strap's insertion clip and can be inserted into the insertion hole of an assembly base. The aforementioned strap clips employ spring clips on the insertion plates to catch against the window holes on insertion holes, forming a shoe that is easy to assemble, can be quickly manufactured and assembled, can be produced in large quantities, and can increase profits. Moreover, pressing the spring clip causes it to spring out of the window hole of the insertion hole, easily separating the strap from the sole. The consumer can then use a strap with another shape or pattern, give the shoes a diverse appearance.

3 Claims, 6 Drawing Sheets

CONSUMER-MODIFIABLE SANDAL OR SLIPPER

BACKGROUND OF THE INVENTION

1. Field of the Invention

This invention is connected with shoes. In more detail, it particularly refers to a strap that can be quickly and easily modified by the consumer, allowing a pair of sandals or slippers to imperceptibly change in appearance.

2. Description of the Related Art

In the case of most commonly used sandals and slippers, the tips and edges of the straps are machine stitched at pre-determined locations on the shoe platform (as shown in FIG. 1), and then attached to the sole. But since the machine stitching technique must be performed by a specialized sewing machine operator, this places a manpower burden on the manufacturer. In addition, due to the curved surface of the shoe and other factors, the machine stitching cannot be completed very fast. This problem therefore raises manufacturing costs and slows the manufacturing process. Furthermore, machine-stitched stitches often tend to part due to wear. When machine stitching work is poorly done, the stitches or thread ends exposed on the protruding parts of the sole may make the shoes uncomfortable to wear. Another aspect is that after the shoe platform and the sole are joined into a single piece, and the instep straps or heel straps are attached to pre-determined locations on the platform through preinstalled holes, the tips of the instep straps and heel straps are inserted into the interior of the platform, after which the platform and sole are laminated together to attach the straps. Although this technique alleviates the machine stitching problems mentioned above, the manufacturing process still has not been simplified, and when holes are punched in the platform during its second processing, the tips of the instep straps and heel straps must be inserted into the holes to pre-determined depths by means of human labor before they are laminated together. This does not shorten the manufacturing Process by any obvious amount of time.

After considering the aforementioned problems in the manufacture of sandals and slippers, the inventor was dissatisfied and thought deeply of how the methods described above were limited by the method of attaching the shoe and the strap. These methods also do not allow the consumer to change the straps. The main intent of this creation is increase the diversity and variability of sandals and slippers.

SUMMARY OF THE INVENTION

The primary goal of this invention is to let the consumer quickly and easily change the straps and therefore increase the diversity of a pair of sandals or slippers, particularly when the consumer has several pairs of sandals or slippers at the same time.

DETAILED DESCRIPTION OF THE PREFERRED EMBODIMENT

Figure 1:
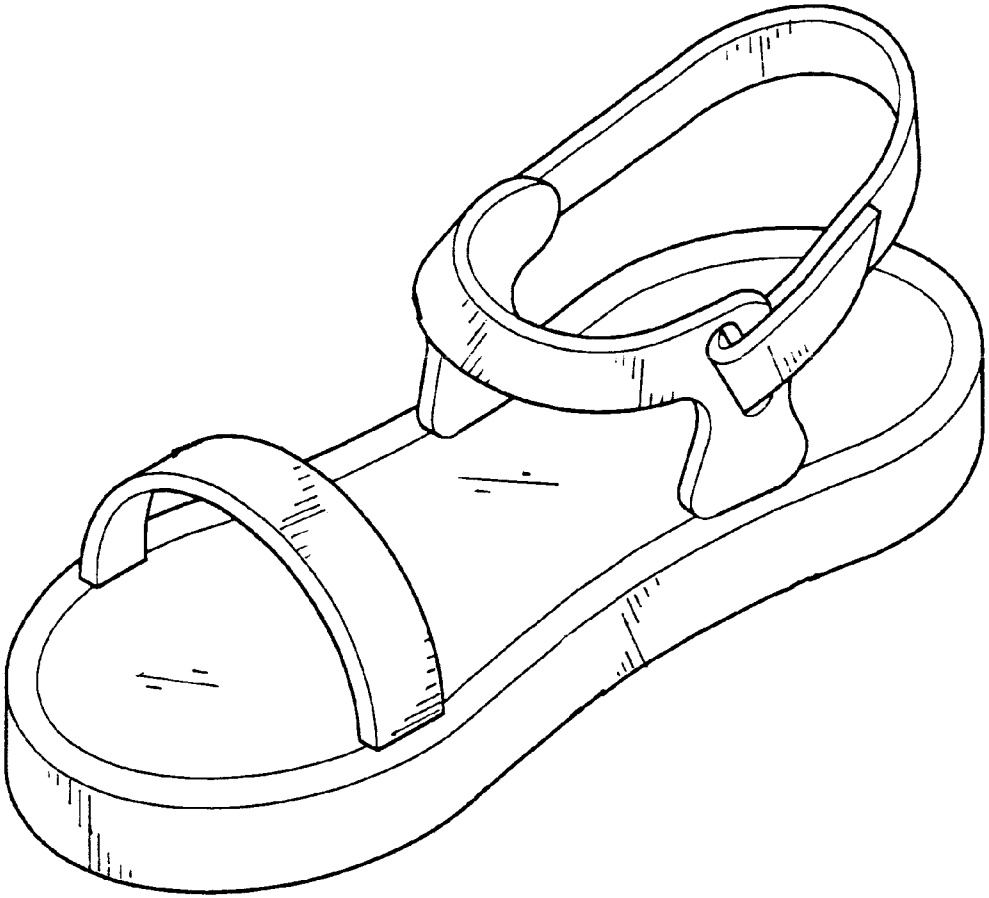
PRIOR ART Fig.1
FIG. 1 shows the external appearance of commonly-used, machine-stitched sandals or slippers.

Please refer to FIGS. 2~6. This invention chiefly includes: Two straps (20) are placed on sole (10), and several assembly bases (30) embedded in sole (10) provide places of attachment or the strap clips (40) on the two ends of strap (20).

Figure 3:
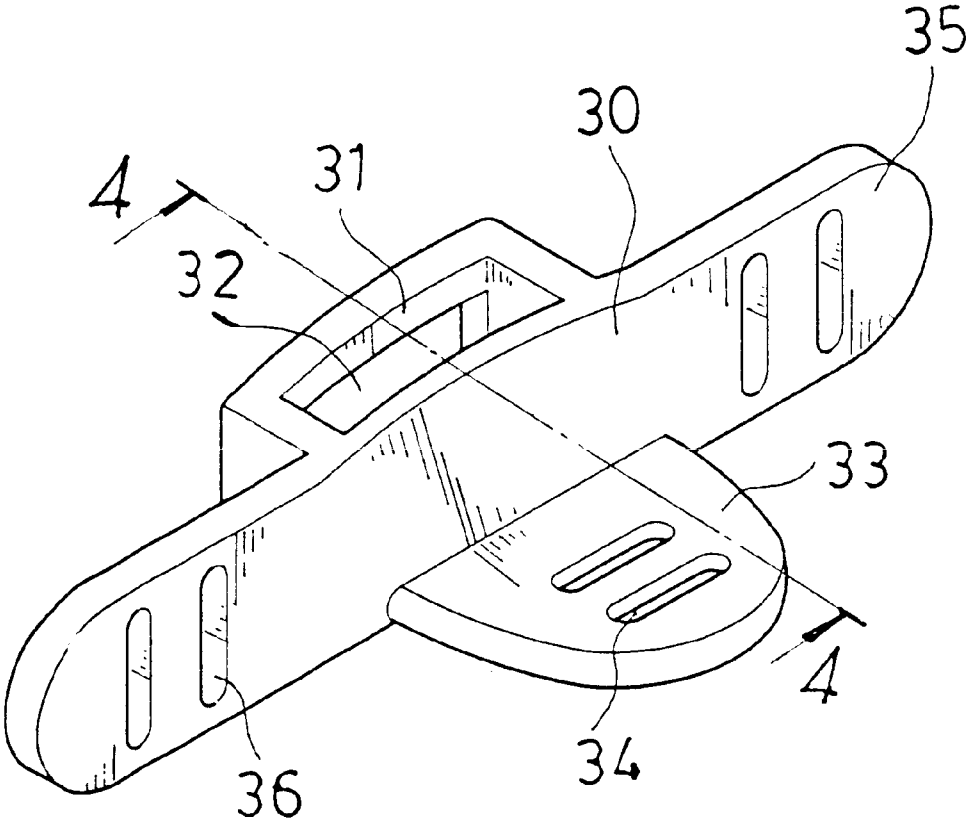
FIG. 3 shows an external view of this invention's attachment base.
Figure 4:
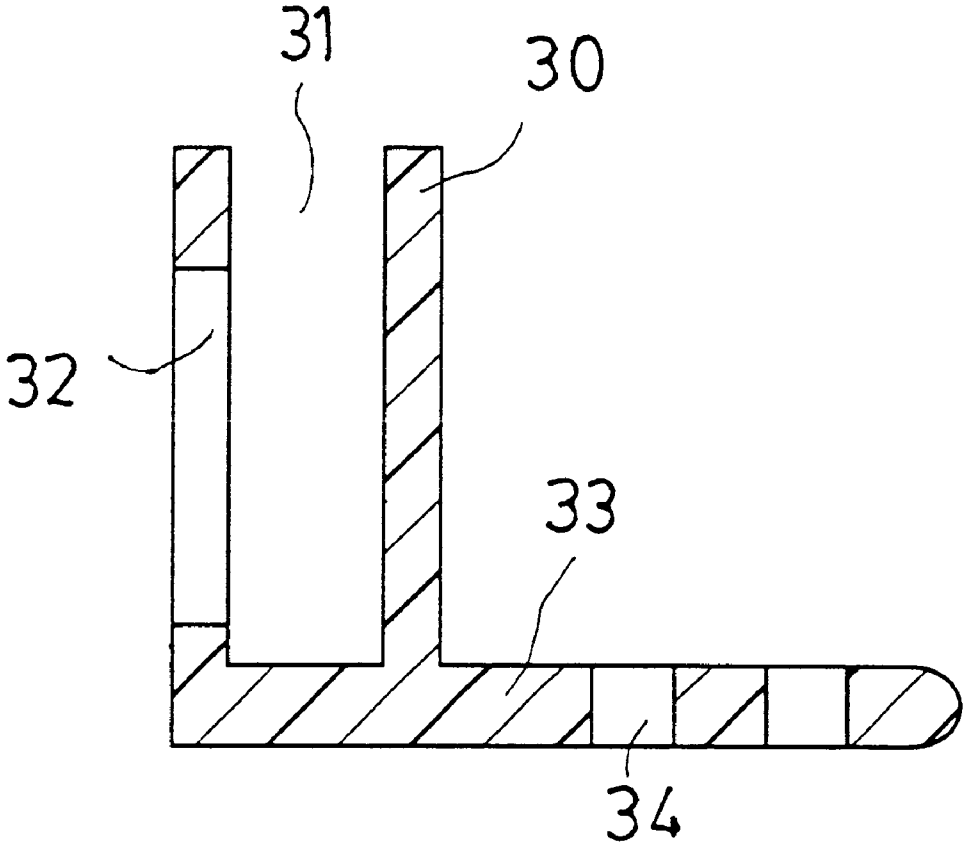
FIG. 4 shows a cutaway view of 4—4 in FIG. 3.

The assembly bases (30) contain insertion holes (31) with upward-facing openings. Window holes (32) pierce the rim of the outer edge of insertion hole (31). In addition, an extension plate (33) protrudes outward from the inner wall of assembly base (30). Several piercing holes (34) are installed in extension plate (33). Outwardly-extending wing plates (35) are mounted on both sides of assembly base (30); several piercing holes (36) are likewise installed in wing plate (35) (as shown in FIGS. 3 and 4).

An insertion plate (41 extends from the bottom of strap clip (40), and can be inserted in the insertion hole (31) or assembly base (30). An elastic spring clip (42) is mounted on insertion plate (41); this spring clip can catch in window hole (32) of insertion hole (31).

Figure 2:
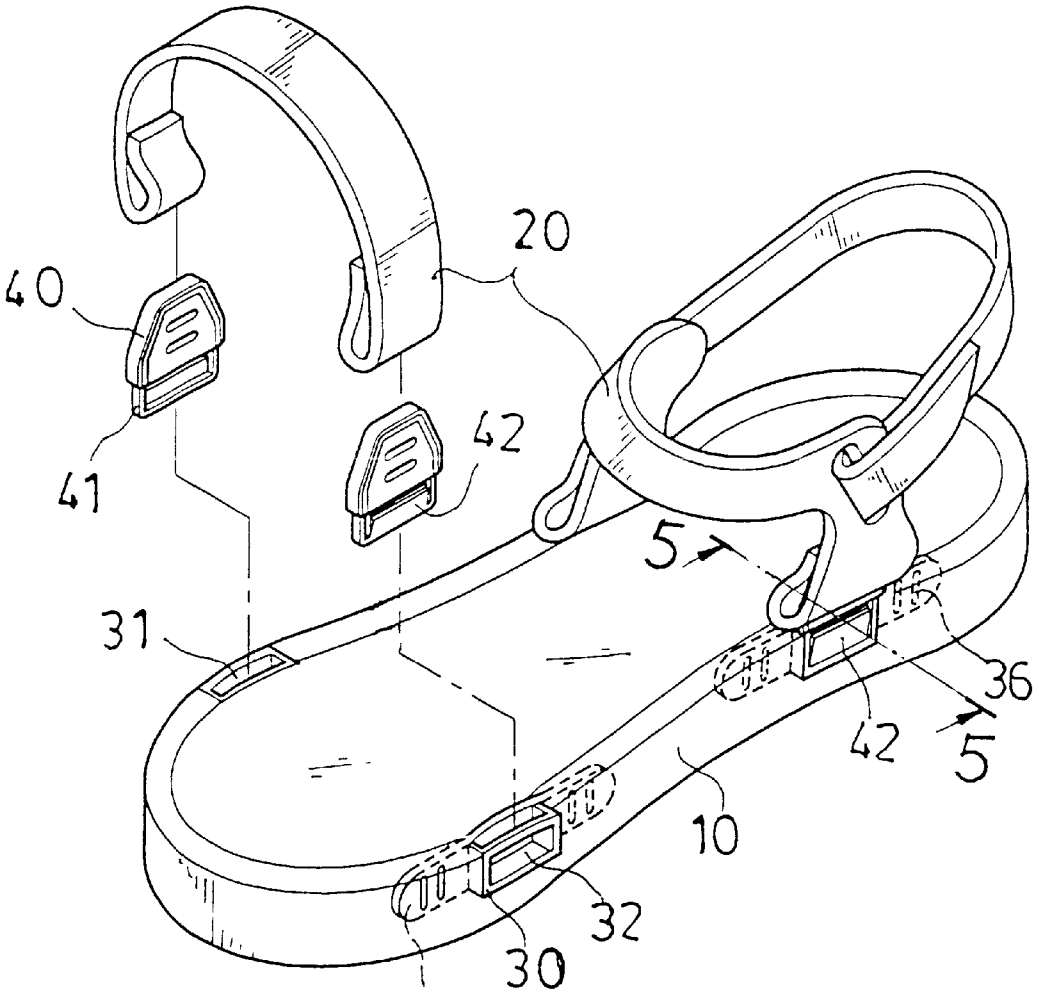
FIG. 2 shows a three-dimensional exploded, view of this invention.
Figure 5:
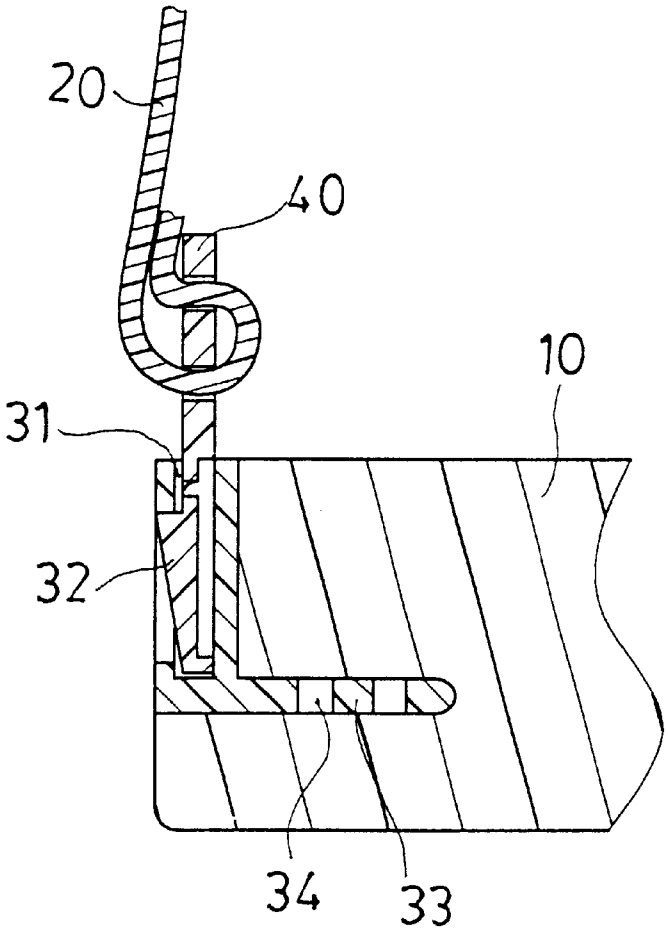
FIG. 5 shows a cutaway view of 5—5 in FIG. 2.

During the production of sole (10), assembly base (30) is first pre-mounted in a mold; after sole (10) is extruded the assembly base (30) will be embedded within sole (10) near the edge (as shown in FIGS. 2 and 5), causing the outer edge of assembly base (30) to be exposed on the edge of sole (10). In other words, only window hole (32) of assembly base (30) will be exposed, and the other portions will be embedded in the interior. Since the extension plates (33) and wing plate (35) of assembly base (30) extend in an outwardly direction, they serve to increase the area of assembly base (30) embedded in sole (10) and strengthen the holding force. In addition, as sole (10) has engulfed assembly base (30), part of the material of sole (10) will have flowed into piercing holes (34) and (36) in extension plates (33) and wing plate (35), causing assembly base (30) to be an even more integral part of the shoe, and to be held even more tightly.

Sole (10) containing assembly bases (30) and strap (20) with strap clips (40) can both be completed at the production factory and assembled by assembly personnel. Alternatively, they can be assembled by the consumer using the following method:

As shown in FIG. 1, insert strap clips (40) into assembly bases (30). The insertion plates (41) on strap clips (40) can be inserted in insertion holes (31) in assembly bases (30). This will cause the spring clips (42) on the insertion plates (41) to catch against the window holes (32) on insertion holes (31) (see FIG. 5). This design facilitates easy assembly, can be produced in large quantities, and will increase profit.

Figure 6:
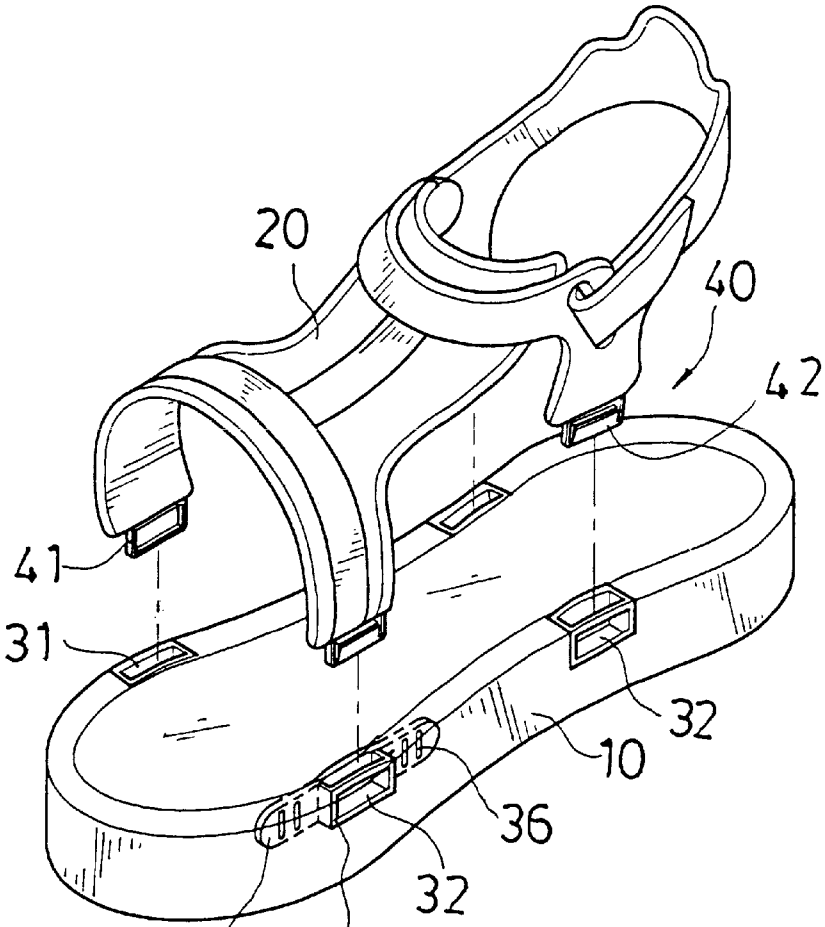
FIG. 6 shows a schematic view of another realization of this invention.

If variation is desired, a different strap (20) with any pattern may be used as shown in FIG. 6. Since window holes (32) are exposed on the exterior of sole (I0), the spring clips (42) inserted in window holes (32) may be directly pressed, causing spring clips (42) to spring out of window holes (32). The insertion plates (41) then can be easily removed from insertions holes (31). In other words, a soft pressing action is sufficient to separate strap (20) and sole (10). As shown in FIG. 6, the strap clips (40) of a new strap (20) can then be inserted in assembly base (30) using the same assembly method described above. This method allows the consumer to easily switch to a new strap (20) with another shape or pattern, which enables the appearance of a single pair of sandals or slippers to be varied, especially when the consumer possesses several pairs or sandals or slippers.

What is claimed is:

1. A sandal that can be modified by a user, the sandal comprising:

a sole;

a plurality of strap clips;

two straps that are inserted into the sole;

a plurality of assembly bases are embedded in the sole to provide places of attachment for the strap clips on two ends of each of the straps and to cause outer edges of the assembly bases to be exposed at edge portions of the sole;

the assembly bases comprise insertion holes with upward-facing openings;

window holes are formed on lateral walls of the assembly bases and are in communication with the insertion holes;

a plurality of insertion plates extend downward from bottom portions of the strap clips, the insertion plates are removably inserted into the insertion holes of the assembly bases;

an elastic spring clip is mounted on each one of the insertion plates;

each of the spring clips is caught in a respective one of the window holes;

when the spring clips of the strap clips are caught in the window holes of the insertion holes, the straps are firmly held in the assembly bases of the sole; and when the spring clip are pressed to spring out of the window holes, the straps are separated from the sole, such that a user can easily replace the straps with different straps to give the sandal a different appearance.

2. A sandal that can be modified by a user, the sandal comprising:

a sole;

a plurality of strap clips;

two straps that are inserted into the sole;

a plurality of assembly bases are embedded in the sole to provide places of attachment for the strap clips on two ends of each of the straps and to cause outer edges of the assembly bases to be exposed at edge portions of the sole;

the assembly bases comprise insertion holes with upward-facing openings;

window holes are formed on lateral walls of the assembly bases and are in communication with the insertion holes;

a plurality of insertion plates extend downward from bottom portions of the strap clips, the insertion plates are removably inserted into the insertion holes of the assembly bases;

an elastic spring clip is mounted on each one of the insertion plates;

each of the spring clips is caught in a respective one of the window holes;

when the spring clips of the strap clips are caught in the window holes of the insertion holes, the straps are firmly held in the assembly bases of the sole; and when the spring clip are pressed to spring out of the window holes, the straps are separated from the sole, such that a user can easily replace the straps with different straps to give the sandal a different appearance; and wherein an extension plate protrudes outwards from an inner wall of each of the assembly bases and outwardly-extending wing plates are mounted on both sides of each of the assembly bases so that the extension plates and wing plates of the assembly bases serve to increase the area of the assembly bases embedded in the sole such that the straps are strongly attached to the sole.

3. The sandal as claimed in claim 5, wherein several piercing holes are provided in the extension plates, the piercing holes are filled by material from the sole so that the assembly bases are integrally formed with the sole.

* * * * *